US008485422B2

(12) United States Patent
Rometty et al.

(10) Patent No.: US 8,485,422 B2
(45) Date of Patent: Jul. 16, 2013

(54) NESTABLE RIGID U-CRATES

(75) Inventors: John A. Rometty, Barrington, IL (US); Jeffrey W. O'Hara, Cherry Valley, IL (US); Lloyd W Lenig, Plymouth, IN (US)

(73) Assignee: Illinois Tool Works Inc., Glenview, IL (US)

( * ) Notice: Subject to any disclaimer, the term of this patent is extended or adjusted under 35 U.S.C. 154(b) by 630 days.

(21) Appl. No.: 12/692,870

(22) Filed: Jan. 25, 2010

(65) Prior Publication Data

US 2010/0187147 A1 Jul. 29, 2010

Related U.S. Application Data

(60) Provisional application No. 61/148,278, filed on Jan. 29, 2009.

(51) Int. Cl.
*B65D 6/16* (2006.01)
*B65D 21/04* (2006.01)

(52) U.S. Cl.
USPC ..... 229/122.32; 206/517; 220/4.26; 220/DIG. 25

(58) Field of Classification Search
USPC ..... 229/122.32, 125.19, 930, 931; 206/443, 206/453, 499, 517, 586; 220/4.26, DIG. 25
See application file for complete search history.

(56) References Cited

U.S. PATENT DOCUMENTS

| | | | | |
|---|---|---|---|---|
| 769,915 | A * | 9/1904 | Nostrand | 229/930 |
| 2,173,927 | A * | 9/1939 | Allen | 229/931 |
| 2,233,207 | A * | 2/1941 | Gillam | 229/930 |
| 2,391,791 | A | 12/1945 | Irving | |
| 3,526,566 | A * | 9/1970 | McIlvain, Jr. et al. | 229/930 |
| 3,669,338 | A * | 6/1972 | Cornell et al. | 229/122 |
| 4,976,374 | A * | 12/1990 | Macaluso | 229/122.32 |
| 5,947,290 | A * | 9/1999 | Loeschen | 206/517 |
| 6,450,398 | B1 * | 9/2002 | Muise et al. | 229/5.84 |

(Continued)

FOREIGN PATENT DOCUMENTS

| | | | |
|---|---|---|---|
| EP | 1291296 | A1 | 3/2003 |
| JP | 2-258547 | A * | 10/1990 |
| WO | 8909733 | A1 | 10/1989 |

OTHER PUBLICATIONS

International Search Report and Written Opinion of the International Searching Authority issued in connection with PCT/US2010/022089 on Mar. 30, 2010.

*Primary Examiner* — Gary Elkins
(74) *Attorney, Agent, or Firm* — Levenfeld Pearlstein, LLC

(57) ABSTRACT

A high density nesting packaging container has first and second preformed, rigid U-shaped members each having a U-shaped cross-section. The U-shaped members are configured to fit into one another to form a rectangular cross-section container. Each of the U-shaped members has a base wall and opposing side walls, the intersection of the base and side walls being rigid. The base wall has a thickness. A narrow slit is formed in the base wall, extending longitudinally along the base wall and formed from an inner surface of the wall into the thickness of the base wall. The base wall is foldable along the slit so as to form a generally W-configuration cross-section. The thus W-configuration, U-shaped members are nestable with each other. When the U-shaped member is unfolded to the U-shaped cross-section, the opposing surfaces formed by the slit abut one another to maintain the crate in the U-shaped cross-section.

11 Claims, 1 Drawing Sheet

U.S. PATENT DOCUMENTS 6,457,636 B1 10/2002 Van De Ven
6,794,018 B2 * 9/2004 Clark ..... 206/586
7,296,728 B2 * 11/2007 Gosis et al. ..... 206/443
7,661,579 B2 * 2/2010 Kruelle et al. ..... 229/930
8,038,003 B2 * 10/2011 Rometty et al. ..... 206/586

* cited by examiner

NESTABLE RIGID U-CRATES

CROSS-REFERENCE TO RELATED APPLICATION

This application claims the benefit of priority of Provisional U.S. Patent Application Ser. No. 61/148,278, filed Jan. 29, 2009, entitled "NESTABLE RIGID U-CRATES".

BACKGROUND OF THE INVENTION

The present invention is directed to rigid packaging containers. More particularly, the present invention pertains to packaging containers formed from rigid U-shaped members that permit high density packing and storage (nesting) configurations.

Packaging takes many forms. One widely popular construction includes a pair of laminated paperboard top and bottom U-shaped channels (U-shaped members or U-crates) configured for one to fit within the other. These packages have become a standard for objects that are linear and/or readily damaged. One well recognized and industry acclaimed package is the REDDI-CRATE® commercially available from ITW Reddi-Pac of Lake Zurich, Ill.

Although the U-shaped members themselves are extremely successful, one drawback is that the U-shaped members must be shipped and stored in their assembled form. As such, the shipping costs and storage costs (and space) can be quite substantial, in large measure because so much of the empty crate is air. This can be problematic as the U-shaped members become larger in sectional area and length.

Prior solutions involve embossing an area or making cuts through the entire U-shaped member in its base and subsequently taping the edges back together such that the U-shaped member can be opened and stacked for shipping. These solutions, however, do not necessarily provide the same strength and protection of the original, unembossed or uncut U-member. Embossing may cause slight gaps and inhibit folding of U-board to its original shape, while cutting straight through a wall and then taping may affect the structural integrity of the U-member.

Accordingly, there exists a need for U-shaped packages that are configured for more densely packing the containers for shipping and storage. More desirably, such a configuration has little to no adverse effect on the strength and integrity of the container as it is used for shipping goods.

BRIEF SUMMARY OF THE INVENTION

A high density nesting packaging container has first and second preformed, rigid U-shaped members each having a U-shaped cross-section when configured for packaging use. The U-shaped members are configured to fit into one another to form a rectangular cross-section container. Each of the U-shaped members has a base wall and opposing side walls, the base and side walls and the intersection of the base and side walls being rigid. The base wall has a thickness through which one or more slits are formed.

In one embodiment, a narrow slit is formed in the base wall, extending longitudinally along the base wall and formed from an inner surface of the wall into the thickness of the base wall. The base wall is openable along the slit, dividing the base into two parts so as to form a generally W-configuration cross-section. The thus W-configured U-shaped members are nestable with each other. In an embodiment, a plurality of slits are formed, parallel to one another, dividing the base into more than two parts, and openable to form the generally W-shaped, or zigzagged, configuration.

When the base wall is closed to form the U-shaped member, the opposing surfaces formed by the slit(s) abut one another to maintain the U-shaped members in the U-shaped cross-section. The U-shaped members may have a coating, such as a liquid-resistant coating, on a surface thereof.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
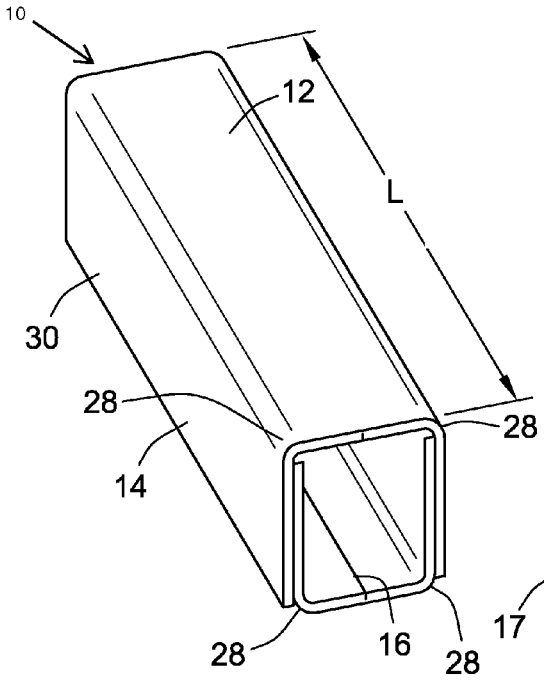
FIG. 1 is perspective view of a packaging container that is configured for nestable stacking and storing.
Figure 2:
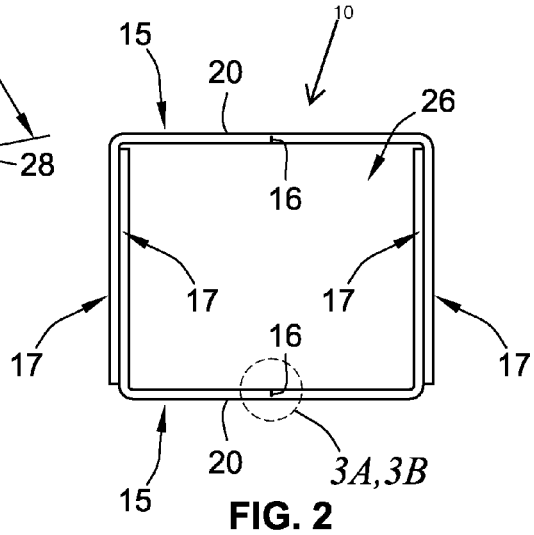
FIG. 2 is an end view of a packaging container in the in-use, U-shaped configuration.

While the present invention is susceptible of embodiment in various forms, there is shown in the drawings and will hereinafter be described presently preferred embodiments with the understanding that the present disclosures are to be considered exemplifications of the invention and are not intended to limit the invention to the specific embodiments illustrated.

It should be further understood that the title of this section of this specification, namely, "Detailed Description Of The Invention," relates to a requirement of the United States Patent Office, and does not imply, nor should be inferred to limit the subject matter disclosed herein.

Referring now to the figures and in particular to FIG. 1, there is shown a packaging container 10, configured to enclose an object. The container 10 is, for example, a REDDI-CRATE® commercially available from ITW Reddi-Pac of Lake Zurich, Ill.

The container 10 is formed as a pair of U-shaped members 12, 14, having a U-shaped cross-section and that are formed from laminated paperboard. Other materials can, of course, be used. Each of the U-shaped members 12,14 includes a base wall 15, and side walls 17 generally perpendicular to the base wall 15. The U-shaped members 12, 14 have been shown to be extremely strong, having a high degree of structural integrity.

The U-shaped members 12,14 are each formed from a layered, or laminated, construction of paper and/or paper board that is subsequently formed into a U-shape (U-shaped cross-section). The U-shaped members 12,14 generally are rigid; that is, the walls are rigidly formed into the U-shape (transverse relative to the base) and are rigid longitudinally along the length of the channel. The walls do not fold down onto the base.

In another embodiment, a U-shaped member has a reinforced base and corners fashioned from alternating layers of paper and/or paper board material of varying widths or strips, and laminating the strips into a board. Narrow strips of material are disposed between wider strips of material such that the narrow strips of material serve as a reinforcing material. The narrow strips of reinforcing material may or may not be the same material as the wider strips of material. In another embodiment, the reinforcing material layer extends across the bottom wall and at least partially up the side walls of the U-board to cover fully the bottom wall of the internal channel as well as the radius of curvature of the corners of the internal channel.

Figure 3A:
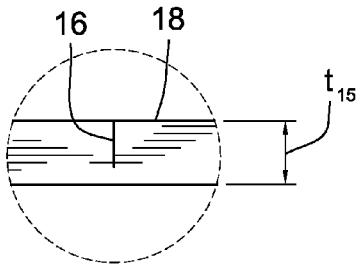
FIGS. 3A and 3B are enlarged views of the slit area of the container of FIG. 2 in use (FIG. 3A) and as the container is opened to the W-configuration cross-section (FIG. 3B)

As seen in FIG. 3A, the container 10 also includes a slit 16 in the inner wall 18 of the container 10 that extends longitudinally along the length L of the container base wall 15. For purposes of this disclosure, the base wall 15 refers to the central portion 20 of the U in both the upper and lower (or inner and outer) U-shaped members 12, 14. The slit 16 is a narrow cut, not a gouge or other substantial material-removing process. The slit 16 is formed through the base wall 15, from the inside, inner surface 26, through about 60 percent to about 70 percent of the wall thickness $t_{15}$.

In one embodiment, the slit is formed in the center of the base wall of the U-shaped member. In another embodiment, two slits are formed, dividing the base wall into thirds. In still another embodiment, more than two slits are formed parallel to one another and dividing the base wall into a plurality of portions. It is anticipated that still other embodiments may form the slit through more than 70% of the wall thickness or less than 60% of the wall thickness, and such depth may depend on the number of slits formed in the base wall 15. It will be appreciated by those with skill in the art that the slit will also penetrate reinforcing material of the base wall that may be present in the 60-70% of the wall thickness.

In a present container 10, the slit 16 is made with a tool to form a slit 16 or separation of the material. Such a tool has a thickness of about $1/64^{th}$ inch, such that the width of the slit is $1/32^{nd}$ inch or less, and preferably about $1/64^{th}$ inch wide. A preferred tool is a non-serrated blade. It will, however, be appreciated that other cutting methods may be used such as laser cutting, or the like, including cutting methods not yet known.

Figure 4:
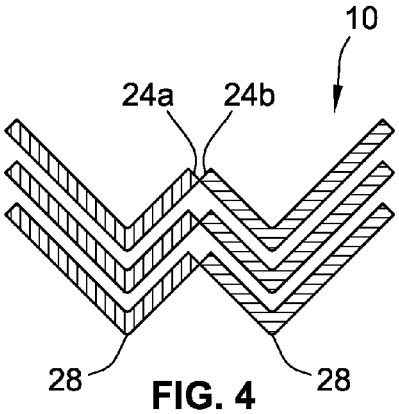
FIG. 4 is an end view of packaging containers that are nested with one another.
Figure 3B:
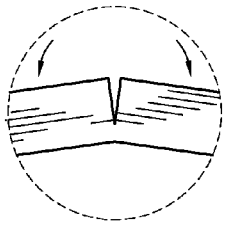

It will be appreciated from the figures that each of the U-shaped members 12, 14 of the present stackable slit-wall container 10, when opened, forms a W-configuration (indicated at 22) that allows the members 12, 14 of the container 10 to be stacked or nested as shown in FIG. 4. Stacking increases the density of the container 10 elements for storage and shipping, thus providing an economical and effective arrangement for such container 10 members 12, 14.

Advantageously, the slit 16 does not substantially effect the structural integrity of the container 10. First, because the slit 16 is narrow, the two opposing walls or surfaces 24*a,b* of the container 10, when the container 10 is "flattened" or "closed" to the U-shape, abut one another and minimize further inward folding. Thus, when the base wall 15 of the member 12, 14 is flattened (closed to the use configuration, as opposed to the shipping/storage open W-configuration), the side walls 17 will be essentially parallel to one another and the member 12, 14 will not fold in on itself Once the upper and lower U-shaped members 12, 14 are fitted into one another to form the complete container 10, the members 12, 14 are typically strapped or taped to close the container 10. In this manner the side walls 17 of each member 12, 14 remain upright and are further supported to prevent the side walls 17 and the base wall(s) 15 from returning to the W-configuration 22.

It will be appreciated that the structural integrity of the container 10 comes, in part, from the strength of the corners 28. It has been found that even though the base wall 15 is slit 16 through thickness $t_{15}$ up to about 60 percent to 70 percent of thickness $t_{15}$, the container 10 exhibits about 80 percent to 85 percent of the strength of a non-slit container.

In addition, the structural integrity of container 10 can be bolstered by surface coating(s) 30. The U-shaped members 12, 14 of a present container 10 are manufactured having various surface coatings 30 that may include polymeric or other liquid-resistant coating so as to provide protection for the contents of the container 10 from water, and the like. As such, forming the slit 16 on the inside of the crate eliminates creating any exposed regions on the outer surface of the container 10 that could otherwise absorb or wick liquids which might compromise the integrity of the container 10. Such coating may be on an outer surface, an inner surface, or both.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it will be observed that numerous modifications and variations can be effected without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A high density nesting packaging container comprising:

a first and a second preformed, rigid U-shaped member, each U-shaped member having a U-shaped cross-section and configured for the first member to fit into the second member to form a rectangular cross-section container, each of the U-shaped members having a base wall, opposing side walls and a corner formed at an intersection of each opposing side wall and the base wall, the base, side walls and corners being rigid, the base wall having a thickness and having at least one slit formed therein, the at least one slit extending longitudinally along the base wall for a length and formed from an inner surface thereof into the thickness of the base wall, the at least one slit having opposing surfaces, the base wall being openable along the at least one slit so as to form a generally W-configuration cross-section such that the first and second U-shaped members are nestable with each other, wherein when the base wall is closed to the U-shaped cross-section, substantially the entirety of the opposing surfaces of the at least one slit abut one another along the length of the at least one slit to maintain the U-shaped member in the U-shaped cross-section.

2. The nesting packaging container in accordance with claim 1 wherein the at least one slit extends through about 60 percent to about 70 percent of the base wall thickness.

3. The nesting packaging container in accordance with claim 1 wherein the at least one slit has a width less than about 1/32 inch.

4. The nesting packaging container in accordance with claim 3 wherein the width of the at least one slit is about 1/64 inch.

5. The nesting packaging container in accordance with claim 1 wherein the U-shaped members have a liquid-resistant coating on a surface thereof.

6. The nesting packaging container in accordance with claim 1 wherein the U-shaped members are each formed from a laminated construction of paper board that is subsequently formed into the U-shape cross-section.

7. The nesting packaging container in accordance with claim 1 wherein the side walls are rigidly formed in a first direction transverse to the base wall and in a second direction parallel to the length of the at least one slit.

8. The nesting packaging container in accordance with claim 1 wherein the base wall and corners are reinforced by alternating layers of material of varying widths.

9. The nesting packaging container in accordance with claim 8 wherein the material of varying widths comprises narrow strips of material and wider strips of material, the narrow strips of material disposed between wider strips of material such that the narrow strips of material serve as a reinforcing material.

10. The nesting packaging container in accordance with claim 9 wherein the narrow strips of material and the wider strips of material both are formed of a paper material.

11. The nesting packaging container in accordance with claim 9 wherein the narrow strips of material and the wider strips of material are formed of different materials.

* * * * *